US008162063B2

(12) United States Patent
Humphreys

(10) Patent No.: US 8,162,063 B2
(45) Date of Patent: Apr. 24, 2012

(54) DUAL GRADIENT DRILLING SHIP

(75) Inventor: Gavin Humphreys, Aberdeen (GB)

(73) Assignee: Stena Drilling Ltd., Aberdeen (GB)

( * ) Notice: Subject to any disclaimer, the term of this patent is extended or adjusted under 35 U.S.C. 154(b) by 0 days.

(21) Appl. No.: 12/875,527

(22) Filed: Sep. 3, 2010

(65) Prior Publication Data

US 2012/0055678 A1 Mar. 8, 2012

(51) Int. Cl.
*E21B 7/12* (2006.01)

(52) U.S. Cl. ..... 166/358; 166/344; 166/352; 166/367; 175/5; 175/217; 405/184.4; 405/224.2

(58) Field of Classification Search ..... 166/358, 166/339, 341, 344–347, 351–355, 367, 368; 175/5–10, 65, 207, 217; 405/158, 169, 172, 405/184.4, 184.5, 224.2–224.4
See application file for complete search history.

(56) References Cited

U.S. PATENT DOCUMENTS

| | | | | |
|---|---|---|---|---|
| 3,981,369 | A * | 9/1976 | Bokenkamp | 175/5 |
| 4,063,602 | A * | 12/1977 | Howell et al. | 175/7 |
| 4,291,772 | A * | 9/1981 | Beynet | 175/5 |
| 4,367,796 | A * | 1/1983 | Bolding | 166/341 |
| 4,716,972 | A * | 1/1988 | Makinen et al. | 175/8 |
| 5,199,821 | A * | 4/1993 | Huete et al. | 405/202 |
| 5,560,436 | A * | 10/1996 | Awad et al. | 175/7 |
| 5,615,115 | A | 3/1997 | Shilling | |
| 6,062,313 | A * | 5/2000 | Moore | 166/357 |
| 6,216,799 | B1 * | 4/2001 | Gonzalez | 175/5 |
| 6,352,114 | B1 * | 3/2002 | Toalson et al. | 166/343 |
| 6,415,877 | B1 * | 7/2002 | Fincher et al. | 175/5 |
| 6,457,529 | B2 * | 10/2002 | Calder et al. | 166/368 |
| 6,536,540 | B2 * | 3/2003 | de Boer | 175/70 |
| 6,648,081 | B2 * | 11/2003 | Fincher et al. | 175/25 |
| 6,745,851 | B1 * | 6/2004 | Edvardsen | 175/5 |
| 6,766,860 | B2 * | 7/2004 | Archibald et al. | 166/341 |
| 6,843,331 | B2 * | 1/2005 | de Boer | 175/70 |
| 6,854,532 | B2 * | 2/2005 | Fincher et al. | 175/5 |
| 6,877,565 | B2 * | 4/2005 | Edvardsen | 166/352 |
| 7,185,705 | B2 * | 3/2007 | Fontana | 166/356 |
| 7,264,058 | B2 * | 9/2007 | Fossli | 166/367 |
| 7,431,081 | B2 * | 10/2008 | Stave | 166/236 |
| 7,497,266 | B2 * | 3/2009 | Fossli | 166/358 |
| 7,628,225 | B2 * | 12/2009 | Petersson et al. | 175/5 |
| 7,677,329 | B2 * | 3/2010 | Stave | 175/5 |
| 7,913,764 | B2 * | 3/2011 | Smith et al. | 166/358 |
| 7,938,190 | B2 * | 5/2011 | Talamo et al. | 166/358 |
| 2004/0031622 | A1 * | 2/2004 | Butler et al. | 175/5 |
| 2004/0238176 | A1 * | 12/2004 | Appleford et al. | 166/353 |
| 2006/0005999 | A1 * | 1/2006 | Butler et al. | 175/5 |
| 2007/0119621 | A1 * | 5/2007 | Stave | 175/5 |
| 2007/0251725 | A1 * | 11/2007 | Banks | 175/5 |
| 2008/0000685 | A1 * | 1/2008 | Humphreys | 175/5 |
| 2008/0190663 | A1 * | 8/2008 | Stave | 175/7 |
| 2009/0032301 | A1 * | 2/2009 | Smith et al. | 175/7 |
| 2009/0114443 | A1 * | 5/2009 | Talamo et al. | 175/7 |
| 2009/0200037 | A1 * | 8/2009 | Fossli | 166/358 |
| 2010/0006297 | A1 * | 1/2010 | Stave | 166/335 |
| 2010/0071906 | A1 * | 3/2010 | Rodrigues | 166/352 |

* cited by examiner

*Primary Examiner* — Thomas Beach
*Assistant Examiner* — Matthew Buck
(74) *Attorney, Agent, or Firm* — Trop, Pruner & Hu, P.C.

(57) ABSTRACT

Dual gradient drilling may be performed by anchoring drilling tubulars from a drilling ship on the seabed. The drilling tubulars may include an inline pump for pumping mud through another set of tubulars that actually drill the well. Then dual gradient drilling may be instituted by controlling the pressure by controlling the operation of the pump.

7 Claims, 5 Drawing Sheets

DUAL GRADIENT DRILLING SHIP

BACKGROUND

This relates generally to dual activity drilling from a drilling ship.

Generally, when drilling in deep water environments, drilling mud is forced down from a drilling ship into a subsurface formation. As used herein, the term "drilling ship" encompasses a floating platform capable of propulsion on its own or by being towed, pushed or pulled, and includes semi-submersible and self-propelled vessels.

When the drilling mud pressure is high, the possibility of fracture and leakage of the formation increases. When the drilling mud pressure is low, the possibility of blowout when the drilling mud pressure is less than the pore pressure arises. Generally, the mud pressure increases with depth. Thus, the deeper the formation, the more prone the formation is to fracture and the more shallower portions of the formation may be more prone to blowout. Thus, the pore pressure is higher the deeper the borehole goes. This means that mud pressure must be increased for well control. In such case, it is necessary to isolate that higher mud pressure from the shallower portions of the formation using casings.

With depth, the pore pressure in the rock and the fracture pressure in the rock begin to diverge. The physics of the subsurface makes it impossible to drill a hole through this transition zone as increased equivalent circulating density through friction of returning drilling mud and the open hole limits the depth the hole can be drilled before exceeding the fracture pressure of the rock. Casing, therefore, is set and cemented.

Therefore, in subsurface situations where there are drilling hazards, such as shallow water flow, it is desirable to drill the top holes using the "pump and dump" drilling method and to set and cement the casing at a depth where drilling can be formed with an equivalent circulating density less than the fracture pressure.

Often, several strings of casing are necessary, including a 36 inch conductor, a 30 inch casing, and a 24 inch casing, which are set and cemented before the 20 inch casing is set, enabling the subsurface blowout preventer and marine riser to be installed on the wellhead.

With the pump and dump drilling technology, the drilling mud is water based and environmentally acceptable to dump on the seabed. The drilling mud needs to have the appropriate rheological properties to assure a stable well bore is maintained. In deep water drilling areas, like the Gulf of Mexico, it is not uncommon to use and lose up to 30 to 40 thousand barrels of mud while drilling these top holes. This may create logistical problems replenishing mud stocks on the rig.

DETAILED DESCRIPTION

Rather than using a pump set on the seabed, a submersible pump may be run from a dual activity drilling ship, including a main well center that drives a submersible pump. Then a secondary well center may be used for actually drilling the well.

Figure 1:
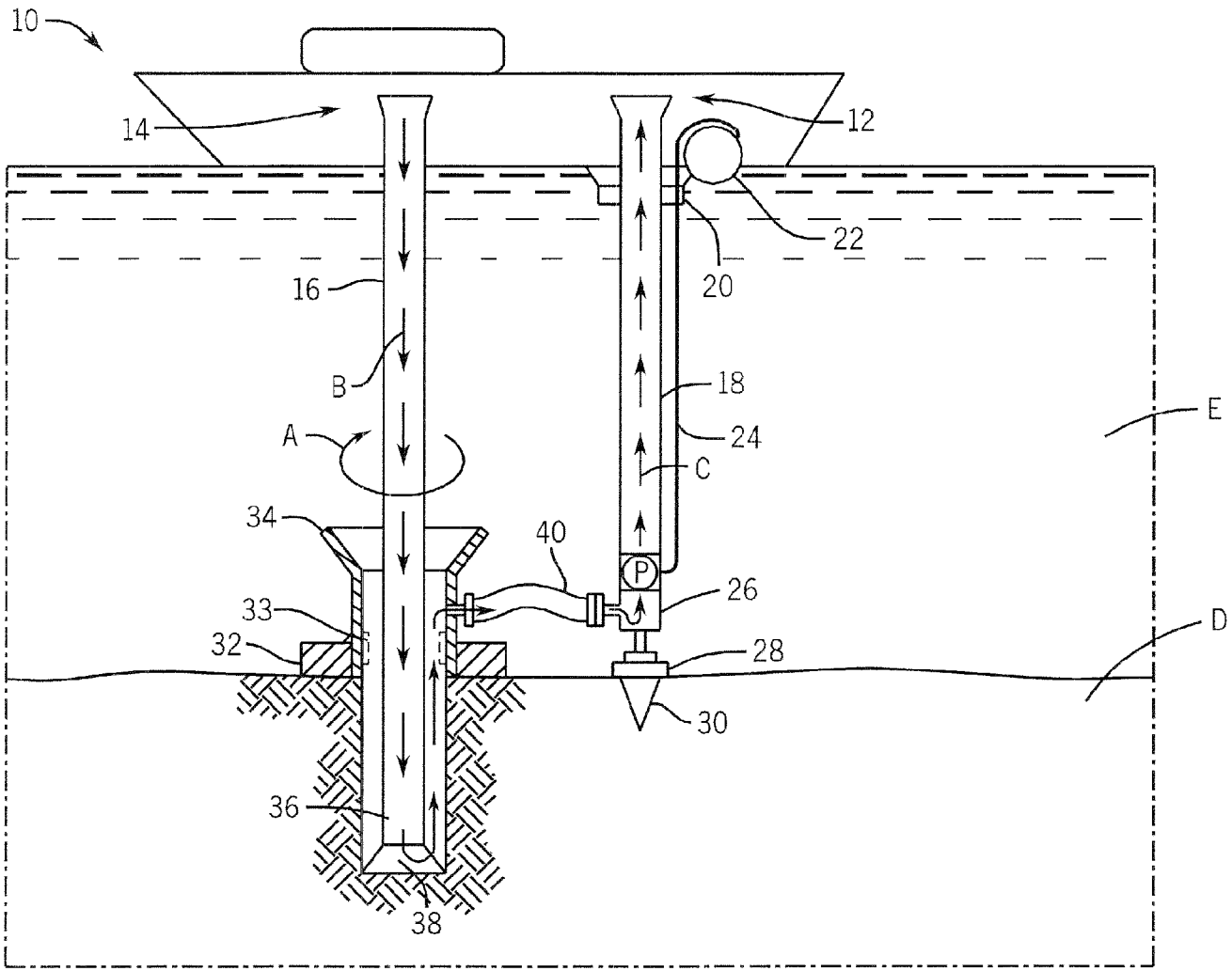
FIG. 1 is a schematic cross-sectional view of one embodiment of the present invention.

Referring to FIG. 1, a floating platform or multiple operation drilling ship 10 is shown in position over a formation in a seabed D under the ocean E. The ship 10 may include a single derrick, which may include multiple levels for different operations. In some embodiments, more than one derrick may be utilized. The ship 10 may include a secondary well center 14 and a main well center 12.

The main well center 12 supports a submersible pump 26 located in the ocean E, proximate to the seabed D. The main well center 12 is anchored on the seabed D using an anchor 30 and a heave compensator 28 coupled to the pump 26. A pump cable 24 extends from the pump 26 through a reel 22. The main well center may be supported by a load ring 20 that hangs off of compensators (not shown) on the main well center 12.

The secondary well center 14 supports the drill pipe 16, which, in one embodiment, may be a 20 inch conductor. The drill pipe 16 may be rotated, as indicated by the arrow A to drill the formation using a drill bit 38. In one embodiment, mud flow is provided from the ship 10 downwardly through the drill pipe 16, as indicated by the arrows B, into the formation through the end 36 of the drill pipe 16.

The drill pipe 16 is supported within a funnel 34 and a drilling guide base 32 in one embodiment. The drilling guide base and funnel are positioned on the seabed D prior to initiation of the drilling operation. The guide based running foot profile is indicated at 33.

The drilling mud, after circulating through the drill bit 38 and annulus, passes upwardly between the formation and the drill pipe 16. Then it passes through a fitting and into a flexible hose 40. From the flexible hose 40 it passes out through another fitting and into the pump 26. The pump 26 forces the drilling mud upwardly, as indicated by the arrow C, back to the drilling ship through the casing 18 of the main well center 12. In one embodiment, the casing 18 may be a 9⅝ inch casing.

The guide base 32 is placed on the seabed with a large hole in the guide base's center. There is a funnel 34 on top of the guide base 32 to guide drilling tools and large casings into the well, to provide a side outlet to connect the well to the submersible pump through the flexible hose, and to provide the ability to view the well with a remotely operated vehicle (ROY) so drilling levels can be regulated at the seabed by speeding up or slowing down the pump 26.

Below the drill string 16 may be casings (not shown in FIG. 1) that are set based on anticipated fracture gradient below the seabed and the hydraulic friction created by the drilling fluids while drilling. So the depth will vary based on local geological and pore pressure knowledge. The gradient in the well is related to the gradient of the drilling fluid in the hole plus the gradient of the sea water from the seabed back to the ship 10.

Dual gradient drilling may be accomplished using the pump 26. The speed of a pump on the ship and the pump 26 may be synchronized so that fluid volume in and out are equal so that the mud level in the annulus remains constant at the seabed.

The anchor 30 may be as simple as a probe stuck into the seabed, if the seabed conditions allow, or as sophisticated as a suction pile anchor, to mention two examples. The compensator 28 may be a pressure or scope joint, such as a compensator bumper sub to cater for rig heave, again, to give a couple of examples.

Figure 2:
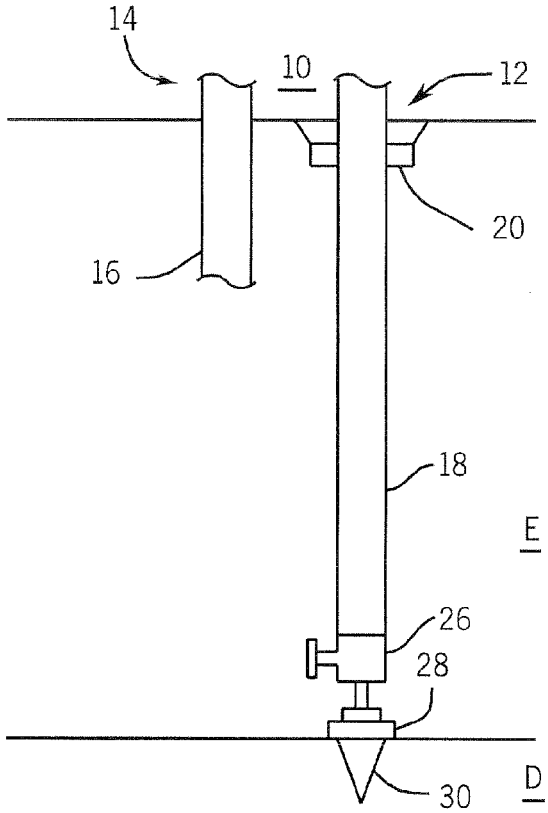
FIG. 2 is a partial, cross-sectional view at an earlier stage to that shown in FIG. 1 in accordance with one embodiment.

Referring to FIG. 2, the sequence of drilling operations begins when the ship 10 arrives at the drilling site. Upon arriving at the site, the casing 18 is extended down to the seabed floor with the anchor 30 and compensator 28 and pump 26 attached. The structure is then anchored on the seabed floor D, as indicated in FIG. 2. Of course, the anchor 30 is set adjacent to the site of the intended well. The secondary well center may have the drill pipe 16 hung off, but not yet extended to the seabed.

Figure 3:
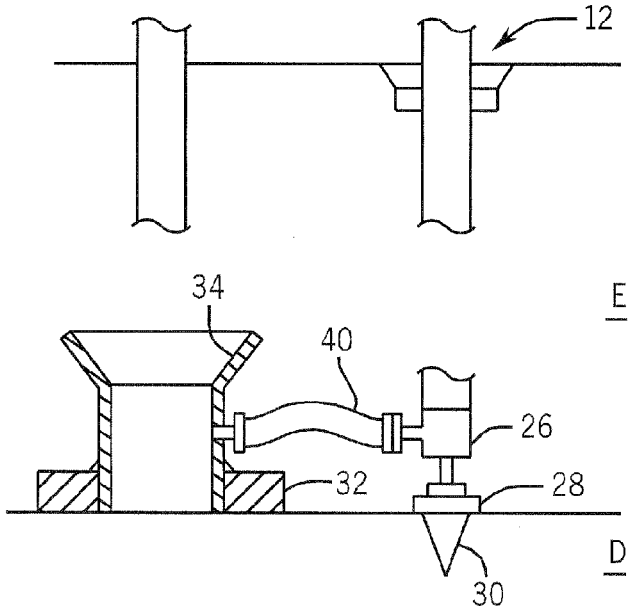
FIG. 3 is a partial, cross-sectional view at a stage subsequent to that shown in FIG. 2 in accordance with one embodiment.

Next, the guide base 32 and funnel 34 are positioned from the secondary well center 14, as indicated in FIG. 3. Then, the flexible pipe 40 is coupled from the funnel 34 to the pump 26 using the fittings as illustrated. This may be done by a remotely operated vehicle (ROV). In one embodiment, the casing 18 may be 9⅝ inch casing to reduce the total weight carried by the ship 10.

Figure 4:
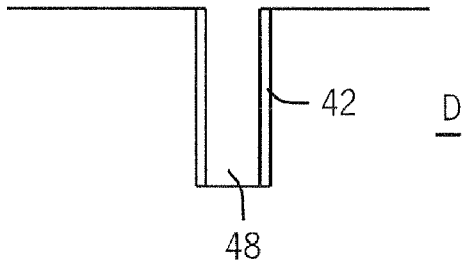
FIG. 4 is an enlarged, cross-sectional view of a wellbore in accordance with one embodiment of the present invention.

Then, referring to FIG. 4, a well 48 is drilled and set into the seabed D using the secondary well center 14 and the drill pipe 16. The setting of casing 42 and drilling is done under dual gradient conditions on the secondary well center. When this drilling operation is completed, the casing 18 and pump 26 may be removed on the main well center 12.

Figure 5:
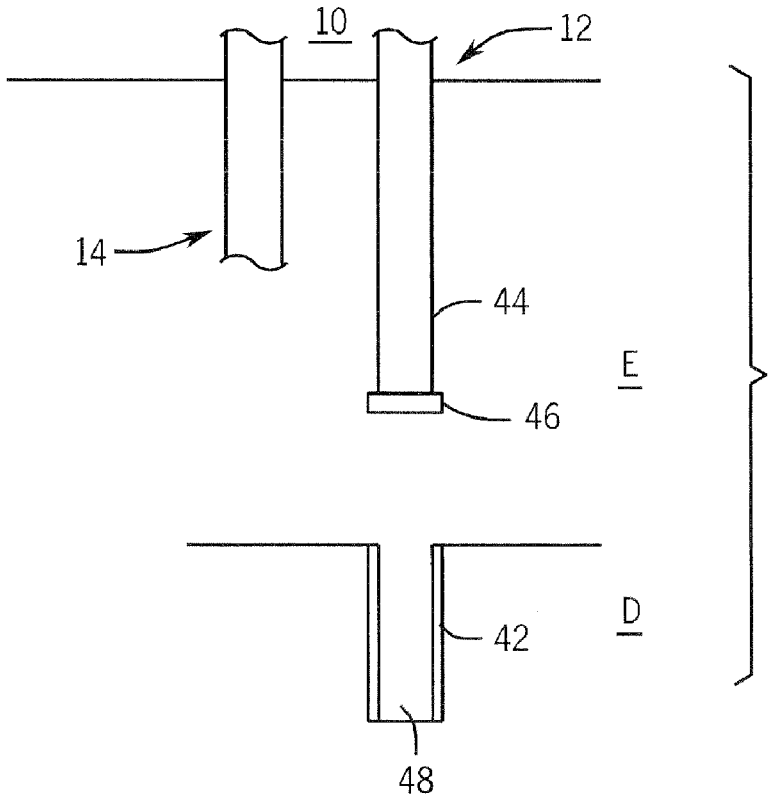
FIG. 5 is an enlarged, cross-sectional view at a subsequent stage to that shown in FIG. 3 in accordance with one embodiment.

Then the guide base 32 and funnel 34 are pulled and casing 42 is run and cemented using the secondary well center while picking up a blowout preventer 46 and running riser 44 on the main well center 12, as shown in FIG. 5. Then the ship 10 is moved to the left, to position the secondary well center 12 over the well 48 and the blowout preventer 46 is run and landed over the well 48.

Figure 6:
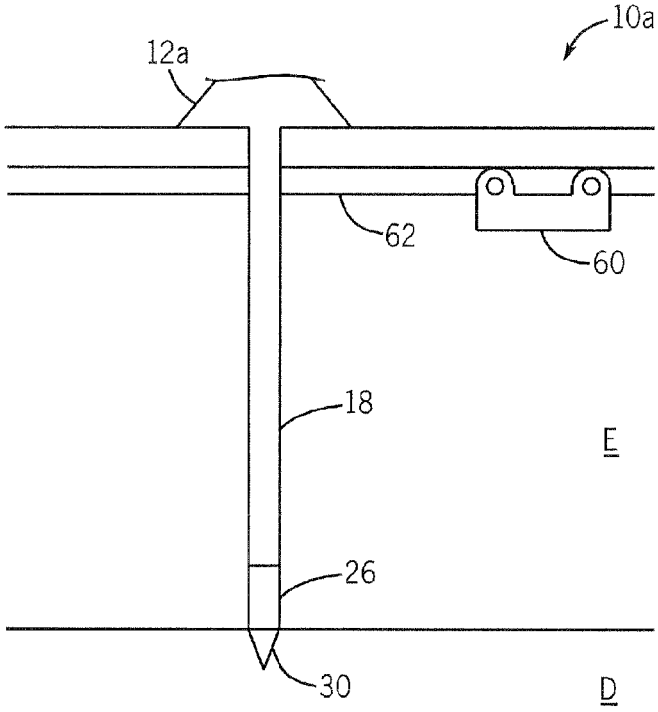
FIG. 6 is an enlarged, cross-sectional view of another embodiment of the present invention.
Figure 7:
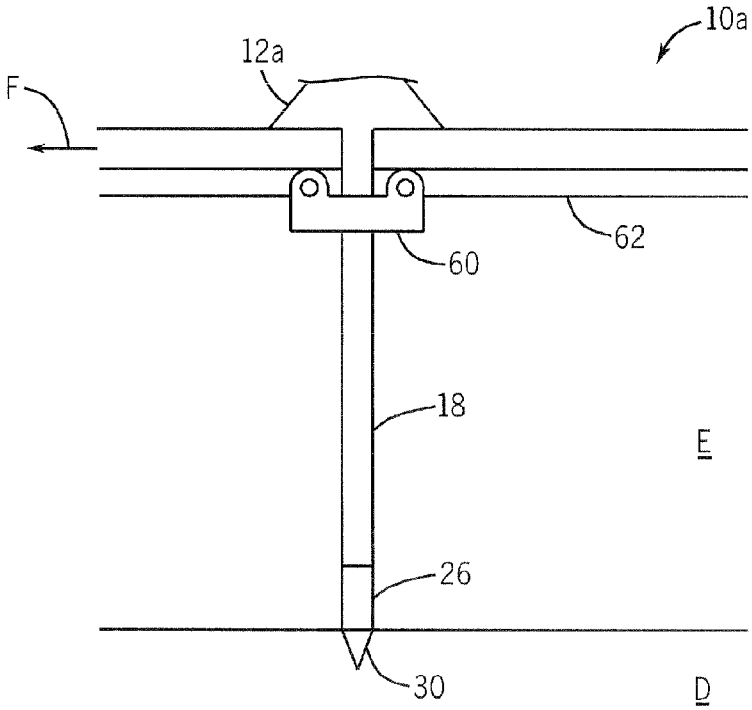
FIG. 7 is an enlarged, cross-sectional view at a subsequent stage in accordance with one embodiment of the present invention.
Figure 8:
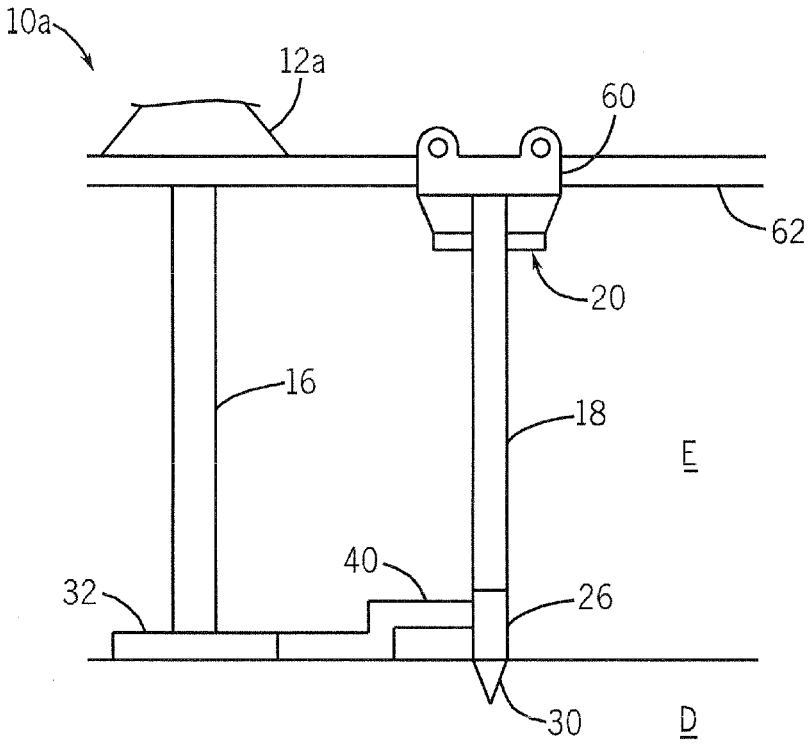
FIG. 8 is an enlarged, cross-sectional view at a subsequent stage in accordance with one embodiment of the present invention.

In accordance with another embodiment, shown in FIGS. 6-8, instead of using two separate well centers, a single well center 12*a*, with a trolley 60, may be utilized from a ship 10*a*. The trolley 60 rides on a track 62.

Initially, the well center 12*a* is used to run casing 18 with a pump 26 and anchor 30, as indicated in FIG. 6. Then the trolley 60 is moved into position to connect to and hang off the casing 18, pump 26, and anchor 30, while they are still anchored in the seabed D. Then the ship 10*a* may be moved, as indicated by the arrow F in FIG. 7, while the core 18 remains stationary. The well center 12*a* is then positioned to the side of the casing 18, pump 26, and anchor 30, as depicted in FIG. 8. Then drill pipe 16 may be run to the seabed D and attached to a base 32. From the base 32, which may include a funnel (not shown), a hose 40 may be connected to the pump 26, as described previously. Then, drilling may proceed as previously described.

References throughout this specification to "one embodiment" or "an embodiment" mean that a particular feature, structure, or characteristic described in connection with the embodiment is included in at least one implementation encompassed within the present invention. Thus, appearances of the phrase "one embodiment" or "in an embodiment" are not necessarily referring to the same embodiment. Furthermore, the particular features, structures, or characteristics may be instituted in other suitable forms other than the particular embodiment illustrated and all such forms may be encompassed within the claims of the present application.

While the present invention has been described with respect to a limited number of embodiments, those skilled in the art will appreciate numerous modifications and variations therefrom. It is intended that the appended claims cover all such modifications and variations as fall within the true spirit and scope of this present invention.

What is claimed is:

1. A method comprising:

anchoring first tubulars, extending from a trolley on a drilling ship, in a seabed floor, said first tubulars including a pump;

extending second tubulars from a drilling station on said ship;

drilling in said seabed with said second tubulars;

pumping mud using said pump in said first tubulars down said second tubulars and up said first tubulars; and moving said ship while maintaining said first tubulars stationary.

2. The method of claim 1 including using dual gradient drilling.

3. The method of claim 1 including anchoring said first tubulars on said seabed before drilling.

4. The method of claim 3 including coupling the second tubulars to said pump after anchoring said first tubulars.

5. The method of claim 1 including drilling using a funnel and a guide base with said second tubulars.

6. The method of claim 5 including providing a mud port through said guide base to said pump.

7. The method of claim 1 including heave compensating said anchored first tubulars.

* * * * *